US011097919B2

(12) United States Patent
Matsumoto et al.

(10) Patent No.: US 11,097,919 B2
(45) Date of Patent: Aug. 24, 2021

(54) RECORDING MATERIAL PROCESSING APPARATUS AND IMAGE FORMING SYSTEM

(71) Applicant: FUJIFILM Business Innovation Corp., Tokyo (JP)

(72) Inventors: Masashi Matsumoto, Kanagawa (JP); Hideaki Ozawa, Kanagawa (JP); Yutaka Nobe, Kanagawa (JP); Takayuki Uchiyama, Kanagawa (JP); Takayuki Fukamachi, Kanagawa (JP); Takuya Makita, Kanagawa (JP); Naoto Terao, Kanagawa (JP); Hiroshi Kato, Kanagawa (JP); Mitsuhiro Nakamura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/846,423

(22) Filed: Apr. 13, 2020

(65) Prior Publication Data

US 2021/0122602 A1 Apr. 29, 2021

(30) Foreign Application Priority Data

Oct. 29, 2019 (JP) ..... JP2019-196438

(51) Int. Cl.

| | |
|---|---|
| ***B31F 1/07*** | (2006.01) |
| ***B65H 37/04*** | (2006.01) |
| ***B31F 5/02*** | (2006.01) |
| *G03G 15/00* | (2006.01) |

(52) U.S. Cl.

CPC ..... *B65H 37/04* (2013.01); *B31F 1/07* (2013.01); *B31F 5/02* (2013.01); *B65H 2301/43828* (2013.01); *B65H 2301/51616* (2013.01); *G03G 15/6544* (2013.01); *G03G 2215/00852* (2013.01)

(58) Field of Classification Search

CPC ..... B31F 1/07; B31F 5/02; B31F 2201/0707; B31F 2201/0754; B65H 37/04; B65H 2301/43828; B65H 2301/51616; G03G 15/6544; G03G 2215/00852

USPC ..... 270/58.08

See application file for complete search history.

(56) References Cited

U.S. PATENT DOCUMENTS

| | | | | |
|---|---|---|---|---|
| 9,090,051 | B2 | 7/2015 | Takahashi et al. | |
| 2014/0227064 | A1* | 8/2014 | Matsue | B42C 1/12 412/37 |
| 2018/0292779 | A1* | 10/2018 | Awano | B42B 4/00 |
| 2018/0339484 | A1* | 11/2018 | Takahashi | G03G 15/6544 |

FOREIGN PATENT DOCUMENTS

| | | |
|---|---|---|
| JP | 2014148398 | 8/2014 |
| JP | 2015229262 | 12/2015 |

* cited by examiner

*Primary Examiner* — Leslie A Nicholson, III
(74) *Attorney, Agent, or Firm* — JCIPRNET

(57) ABSTRACT

A recording material processing apparatus includes first teeth that are used for binding processing of a recording material bundle; second teeth that move along a linear route toward the first teeth and presses the recording material bundle located between the first teeth and the second teeth; and a guide portion that is disposed along the linear route and guides the second teeth moving toward the first teeth.

15 Claims, 11 Drawing Sheets

RECORDING MATERIAL PROCESSING APPARATUS AND IMAGE FORMING SYSTEM

CROSS-REFERENCE TO RELATED APPLICATIONS

This application is based on and claims priority under 35 USC 119 from Japanese Patent Application No. 2019-196438 filed Oct. 29, 2019.

BACKGROUND

(i) Technical Field

The present invention relates to a recording material processing apparatus and an image forming system.

(ii) Related Art

JP2015-229262A discloses a configuration in which a lower teeth is attached to a lower tooth block that is held to be movable to a position where the lower teeth mesh with the upper teeth, and the lower teeth that have moved to the position where the lower teeth mesh with the upper teeth is fixed to a lower arm with a screw.

JP2014-148398A discloses a paper binding apparatus including a pair of pressure bonding members and a pressure bonding member moving unit that moves a movable pressure bonding member that is one of the pair of pressure bonding members.

SUMMARY

In binding processing for a recording material bundle, for example, the teeth may be advanced to the recording material bundle, the teeth may be pushed against the recording material bundle, the recording materials constituting the recording material bundle may be pressure-bonded to each other, and the binding processing of the recording material bundle is performed.

Here, for example, in a case where the teeth move along a curved route as the teeth advance toward the recording material bundle, the accuracy of the teeth position in a case where the teeth are pushed against the recording material bundle decreases. In this case, there is a concern that the quality of the binding performed on the recording material bundle degrades.

Aspects of non-limiting embodiments of the present disclosure relate to a recording material processing apparatus and an image forming system that improve the quality of binding performed on a recording material bundle compared to a configuration in which teeth move along a curved route and are pushed against a recording material bundle.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a recording material processing apparatus including first teeth that are used for binding processing of a recording material bundle; second teeth that move along a linear route toward the first teeth and presses the recording material bundle located between the first teeth and the second teeth; and a guide portion that is disposed along the linear route and guides the second teeth moving toward the first teeth.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described in detail with reference to the accompanying drawings.

Figure 1:
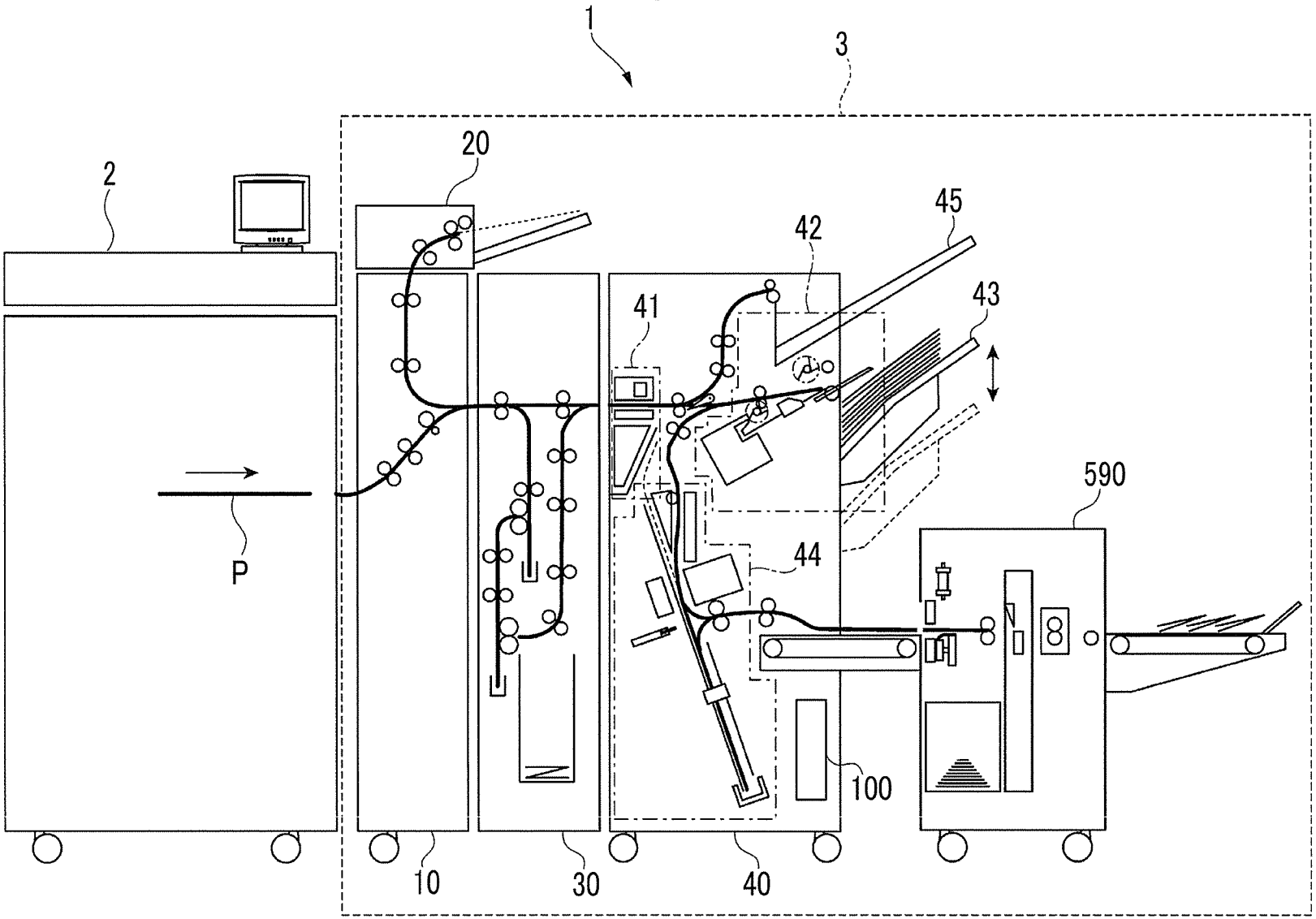
FIG. 1 is a diagram illustrating an overall configuration of an image forming system.

FIG. 1 is a diagram illustrating an overall configuration of the image forming system 1.

The image forming system 1 illustrated in FIG. 1 includes an image forming apparatus 2 that forms an image on paper P as an example of a recording material and the paper processing apparatus 3 that perform predetermined processing on the paper P on which the image has been formed by the image forming apparatus 2.

Here, the image forming apparatus 2 forms the image on the paper P by using an electrophotographic method or an ink jet method.

The paper processing apparatus 3 as an example of a recording material processing apparatus is provided a transport device 10 that transports the paper P output from the image forming apparatus 2 to the downstream side, and an interleaf paper supply device 20 that supplies interleaf paper such as thick paper or paper P with a window to the paper P transported by the transport device 10.

Additionally, the paper processing apparatus 3 is provided with a folding device 30 that performs folding processing such as inner tri-folding (C-folding) or outer tri-folding (Z-folding) on the paper P transported from the transport device 10.

Additionally, the paper processing apparatus 3 is provided with a first post-processing device 40 that is provided downstream of the folding device 30 and that performs punching, end binding, saddle binding, and the like on the paper P.

In addition, the first post-processing device 40, which performs processing on a paper bundle (an example of a recording material bundle) including a plurality of sheets of paper P on which images are formed by the image forming apparatus 2 and performs processing for the paper P on each sheet of paper P, is provided on the downstream side of the folding device 30.

Additionally, the paper processing apparatus 3 is provided with a second post-processing device 590 that is provided downstream of the first post-processing device 40 and further performs processing on the paper bundle that is center-folded or saddle-bounded.

Additionally, the paper processing apparatus 3 is provided with a control unit 100 constituted by a central processing unit (CPU) that executes a program and controls the entire paper processing apparatus 3.

The first post-processing device 40 is provided with a punching unit 41 that performs punching the paper P and an end-binding stapler unit 42 that binds the end of the paper bundle.

Additionally, a first stacking part 43 on which the paper P that has passed through the end-binding stapler unit 42 is stacked, and a second stacking part 45 on which the paper P on which the processing in the first post-processing device 40 is not performed or the paper P on which only the punching is performed is stacked are provided.

Moreover, the first post-processing device 40 is provided with a saddle binding unit 44 that center-fold or saddle-binds the paper bundle to produce a spread-like booklet.

Figure 2:
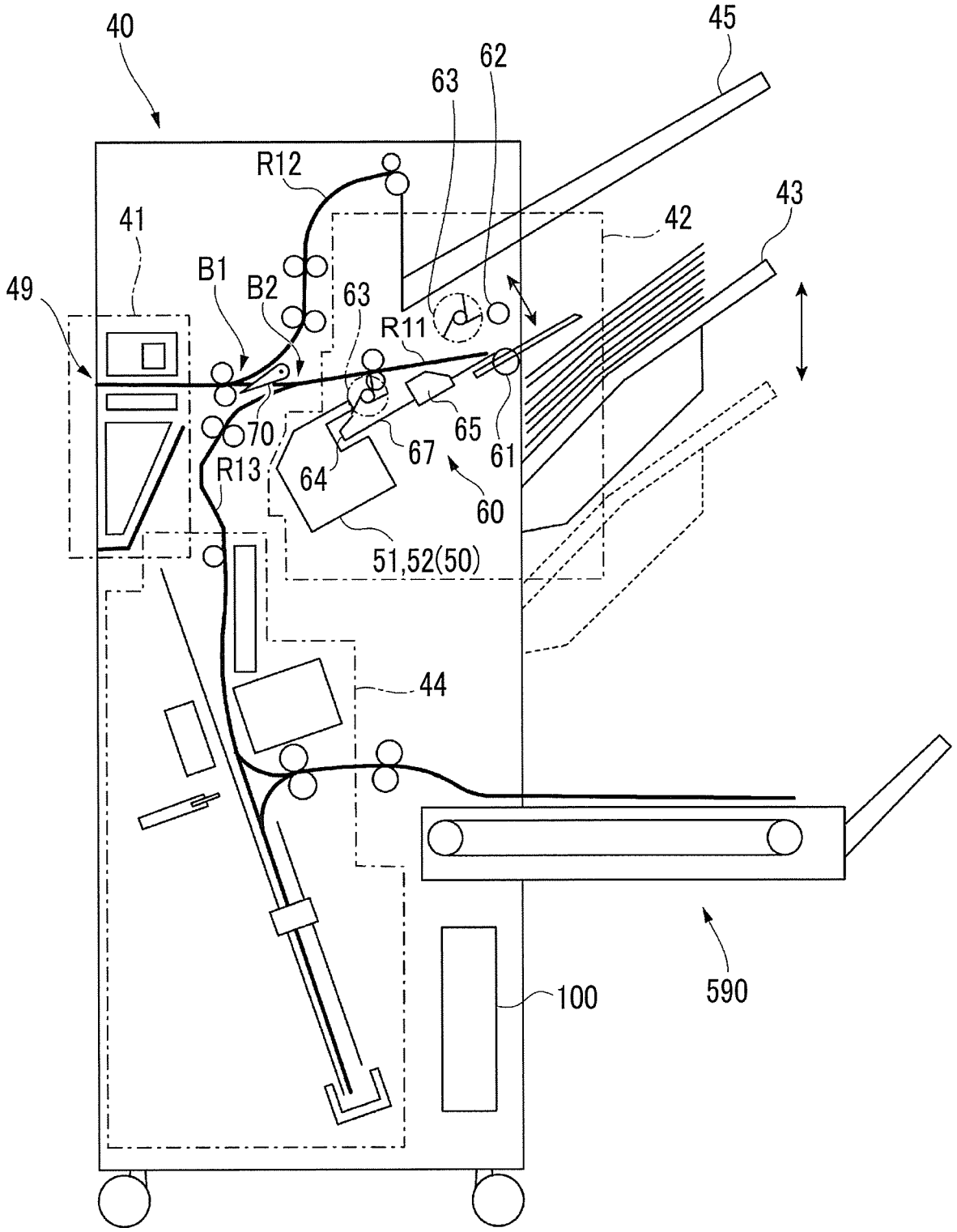
FIG. 2 is a diagram illustrating a configuration of a first post-processing device.

FIG. 2 is a diagram illustrating the configuration of the first post-processing device 40.

The first post-processing device 40 is provided with a receiving port 49 that receives the paper P transported from the folding device 30.

The punching unit 41 is provided immediately behind the receiving port 49. The punching unit 41 performs punching for two or four holes on the paper P transported to the first post-processing device 40.

Additionally, a first paper transport route R11, which is provided from the receiving port 49 to the end-binding stapler unit 42 and is used for transporting the paper P received at the receiving port 49 to the end-binding stapler unit 42, is provided.

Moreover, a first branch part 31 is provided with a second paper transport route R12 that branches from the first paper transport route R11 and is used for transporting the paper P to the second stacking part 45.

Additionally, a second branch part B2 is provided with a third paper transport route R13 that branches from the first paper transport route R11 and is used for transporting the paper P to the saddle binding unit 44.

Additionally, a switching gate 70 that switches (sets) a transport destination of the paper P to any one of the first paper transport route R11 to the third paper transport route R13 is provided.

The end-binding stapler unit 42 is provided with the paper stacking section 60 that stacks a required number of sheets of paper P to generate the paper bundle.

The paper stacking section 60 is provided with a support plate 67 that is disposed to be inclined with respect to the horizontal direction and supports the transported paper P from below. In the exemplary embodiment, the paper bundle is generated on the support plate 67.

Moreover, the end-binding stapler unit 42 is provided with a binding processing device 50 that executes binding (end binding) on an end of the paper bundle generated at the paper stacking section 60.

In addition, in the exemplary embodiment, as will be described below, two binding processing devices 50 are provided, including a first binding processing device 51 that performs binding processing using staples and a second binding processing device 52 that performs binding processing without using staples.

Additionally, the end-binding stapler unit 42 is provided with a transport roll 61 that performs rotational driving and delivers the paper bundle generated at the paper stacking section 60 to the first stacking part 43.

Moreover, a movable roll 62 is provided that is movable to a position where the movable roll has retreated from the transport roll 61 and a position where the movable roll is brought into pressure contact with the transport roll 61.

Here, in a case where the processing is performed by the end-binding stapler unit 42, first, the transported paper P is received at the receiving port 49.

Thereafter, the paper P is transported along the first paper transport route R11, and reaches the end-binding stapler unit 42.

Then, the paper P is transported to a position above the support plate 67 and then falls onto the support plate 67.

Additionally, the paper P is supported from below by the support plate 67, and slidingly moves on the support plate 67 by the inclination given to the support plate 67 and a rotating member 63.

Thereafter, the paper P bumps against an end guide 64 attached to an end of the support plate 67. In addition, in the exemplary embodiment, the end of the support plate 67 is provided with the end guide 64 extending upward in the drawing, and the paper P that has moved on the support plate 67 bumps against the end guide 64.

Accordingly, in the exemplary embodiment, the movement of the paper P is stopped. Thereafter, this operation is performed whenever the paper P is transported from the upstream side, and the paper bundle in which the paper P is aligned is generated on the support plate 67.

In addition, in the exemplary embodiment, a paper width position alignment member 65 that aligns the position of the paper bundle in the width direction is further provided.

In the exemplary embodiment, whenever the paper P is supplied onto the support plate 67, an end (side portion) of the paper P in the width direction is pressed by the paper width position alignment member 65, and the position of the paper P (paper bundle) in the width direction is also changed.

In a case where a predetermined number of sheets of paper P are stacked on the support plate 67, the first binding processing device 51 and the second binding processing device 52 execute binding on the end of the paper bundle.

In addition, the first binding processing device 51 executes binding by driving metallic staples (U-shaped needles) into the paper bundle. Additionally, the second binding processing device 52 executes binding by sandwiching the paper bundle between two binding teeth and pressure-bonding paper sheets constituting the paper bundle to each other.

Thereafter, in the exemplary embodiment, the movable roll 62 advances toward the transport roll 61, and the paper bundle is sandwiched between the movable roll 62 and the transport roll 61. Thereafter, the transport roll 61 is driven to rotate, and the paper bundle is transported to the first stacking part 43.

In addition, the first binding processing device 51 and the second binding processing device 52 are provided so as to be movable toward the far side and the near side of the paper plane in the drawing, and in the exemplary embodiment, the binding processing on the paper P can be performed in a plurality of points.

Figure 3:
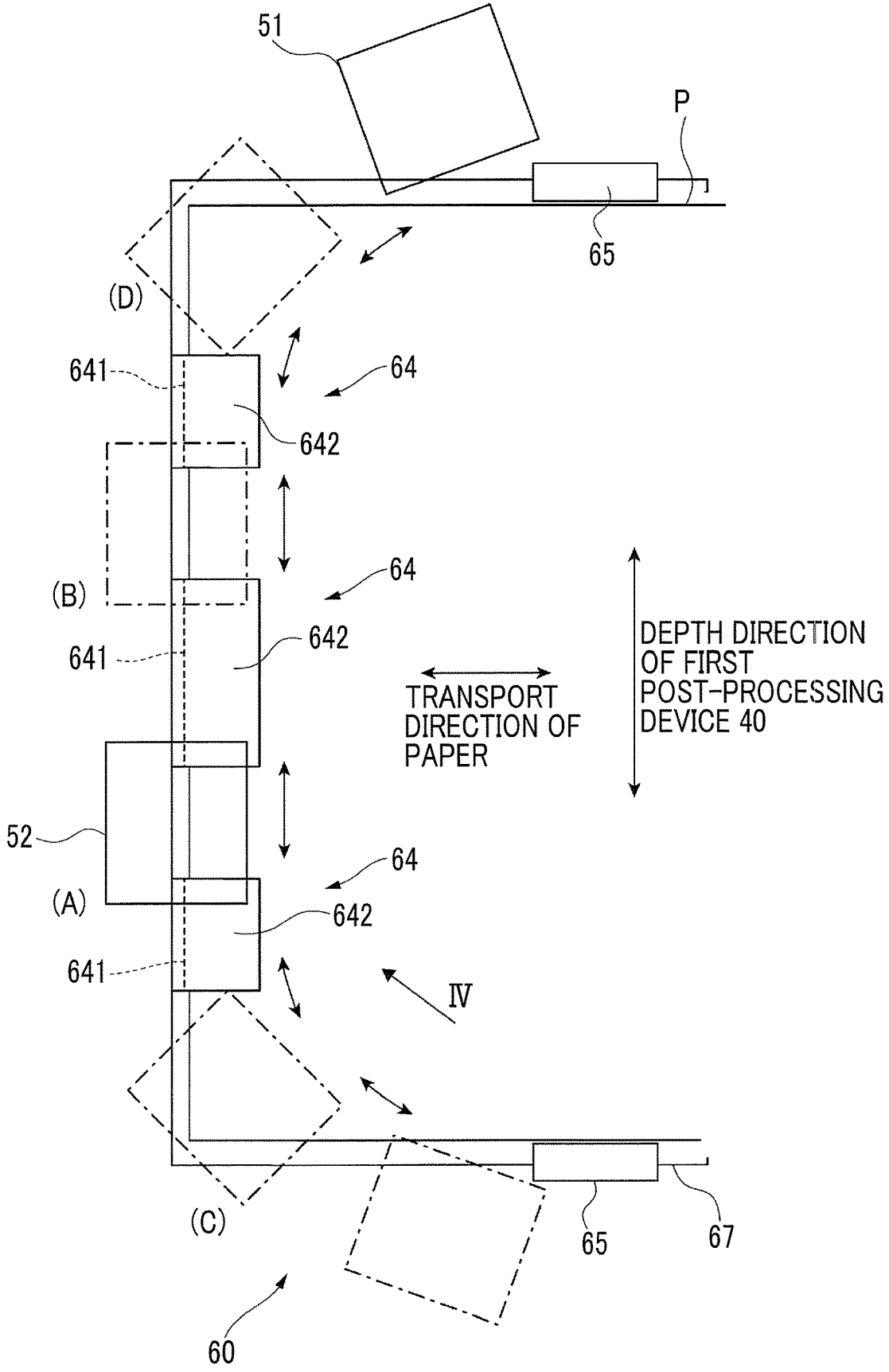
FIG. 3 is a diagram in a case where a paper stacking section is viewed from above.

Referring to and further describing FIG. 3 (a diagram in a case where the paper stacking section 60 is viewed from above), in the exemplary embodiment, as described above, the first binding processing device 51 and the second binding processing device 52 are provided.

The first binding processing device 51 and the second binding processing device 52 are disposed such that the positions of the first post-processing device 40 in the depth direction are different from each other.

In the exemplary embodiment, the first binding processing device 51 and the second binding processing device 52 move in the depth direction of the first post-processing device 40, which is a direction orthogonal to the transport direction of the paper P (paper bundle).

In addition, in the exemplary embodiment, the first binding processing device 51 and the second binding processing device 52 move along one common route.

In the exemplary embodiment, the first binding processing device 51 and the second binding processing device 52 are movable, and can perform binding processing on a plurality of points of the paper bundle.

Here, the first binding processing device 51 and the second binding processing device 52 respectively stop at, for example, two points located at mutually different points in the depth direction of the first post-processing device 40 (position (A) and position (B) in FIG. 3) and perform binding processing (two-point end binding processing) at these two points.

Additionally, each of the first binding processing device 51 and the second binding processing device 52 stops at, for example, one end (one corner of the paper bundle) (position (D) in FIG. 3) of the paper bundle, and binding processing (single-point end binding) is performed at this stop position.

Additionally, each of the first binding processing device 51 and the second binding processing device 52 stops at, for example, the other end (the other corner of the paper bundle) (position (C) in FIG. 3) of the paper bundle and binding processing (single-point end binding) is performed at this stop position.

Here, in the exemplary embodiment, each of the first binding processing device 51 and the second binding processing device 52 moves linearly between the position (A) and the position (B), and each of the first binding processing device 51 and the second binding processing device 52 moves while rotates by, for example, 45° between the position (A) and the position (C) and between the position (B) and the position (D).

Here, in the exemplary embodiment, as illustrated in FIG. 3, a plurality of the end guides 64 are provided.

The end guides 64 are disposed at mutually different points in the depth direction (the direction orthogonal to the transport direction of the paper P) of the first post-processing device 40.

Additionally, each of the end guides 64 has a restricting portion 641 and a facing piece 642 as illustrated in FIG. 3.

The restricting portion 641 is disposed in a relationship orthogonal to the support plate 67, and in the exemplary embodiment, the movement of the paper P is restricted by the end of the paper P bumping against the restricting portion 641.

The facing piece 642 is connected to the restricting portion 641 and is disposed to face the support plate 67.

In the exemplary embodiment, in a case where the paper P is placed on the support plate 67, the end of the paper P enters between the facing piece 642 and the support plate 67. Moreover, the end of the paper P bumps against the restricting portion 641. Accordingly, the paper P is aligned.

In addition, in a case where the binding processing is performed at the position (A) in FIG. 3, the binding processing is performed through a gap formed between the facing piece 642 located at the center (the center in the upward-downward direction) in FIG. 3 and the facing piece 642 located at a lower portion in drawing.

Additionally, in a case where the binding processing is performed at the position (B) in FIG. 3, the binding processing is performed through a gap formed between the facing piece 642 located in the upper portion of FIG. 3 and the facing piece 642 located in the center in the drawing.

Figure 4:
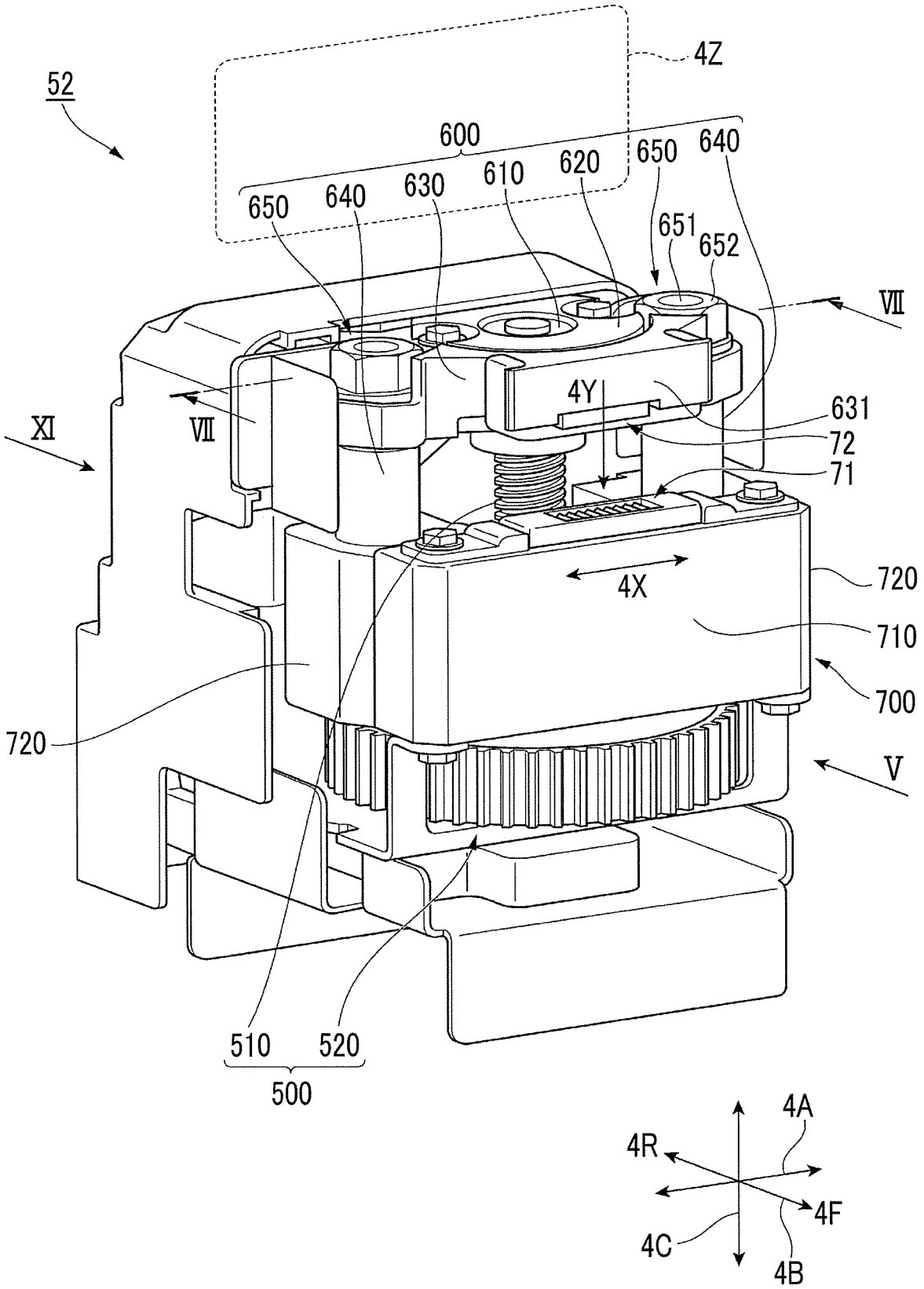
FIG. 4 is a diagram in a case where a second binding processing device is viewed from a direction indicated by arrow IV in FIG. 3.
Figure 5:
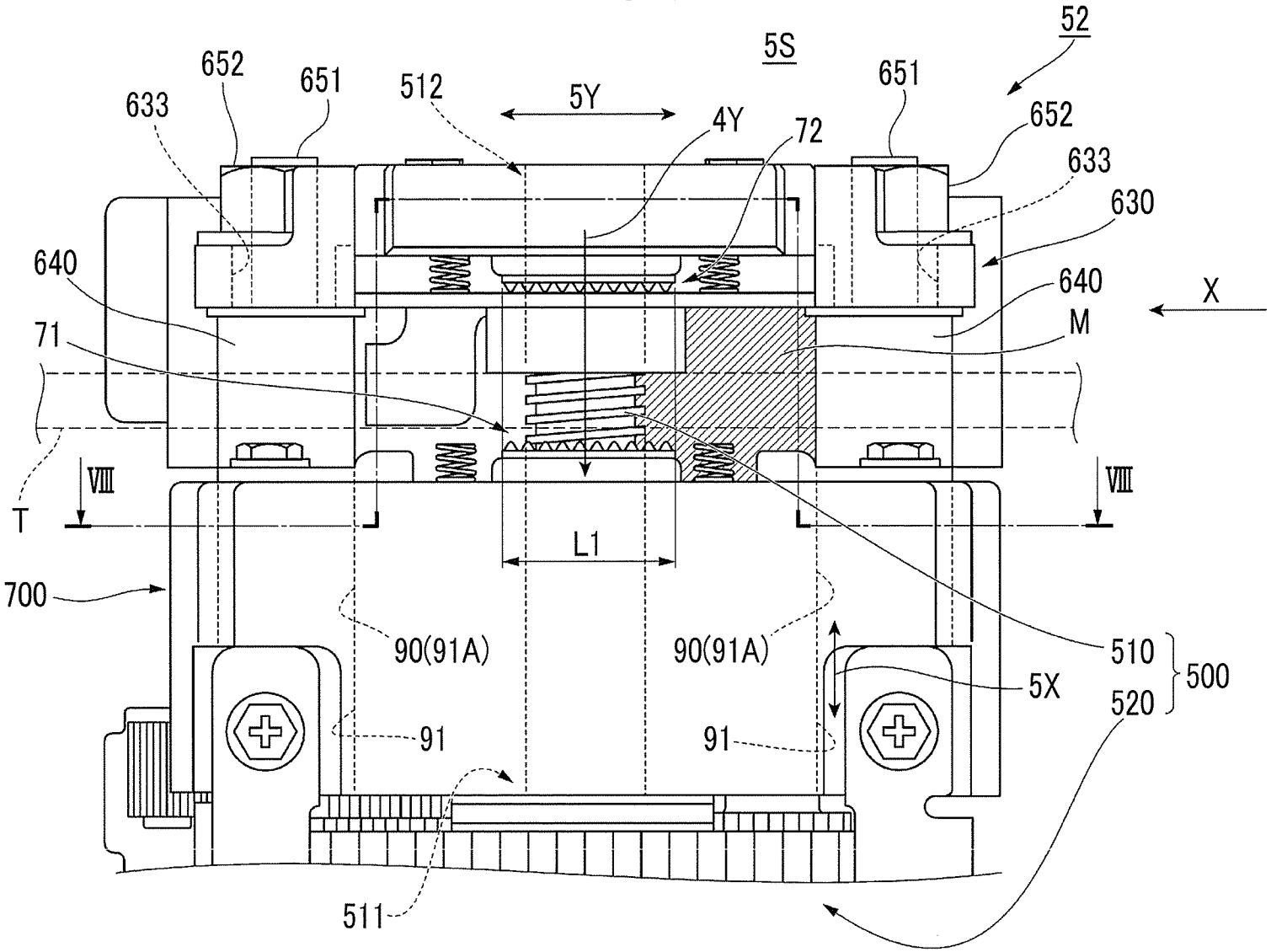
FIG. 5 is a diagram in a case where the second binding processing device is viewed from the direction of arrow V in FIG. 4.

FIG. 4 is a diagram in a case where the second binding processing device 52 is viewed from a direction indicated by arrow IV in FIG. 3. FIG. 5 is a diagram in a case where the second binding processing device 52 is viewed from the direction of arrow V in FIG. 4. In addition, FIG. 5 is a diagram in a case where the second binding processing device 52 is viewed from the front.

In addition, in FIG. 4, a direction indicated by arrow 4A is hereinafter referred to as a width direction of the second binding processing device 52, and a direction indicated by arrow 4B is referred to as a depth direction of the second binding processing device 52. Additionally, a direction indicated by arrow 4C is referred to as a height direction of the second binding processing device 52.

Additionally, in the present specification, a direction indicated by arrow 4R in the drawing is referred to as a rear direction or a rear side, and a direction indicated by arrow 4F in the drawing is referred to as a front direction or a front side.

As illustrated in FIG. 4, the second binding processing device 52 is provided with first binding teeth 71 used for binding processing of a paper bundle T (refer to FIG. 5) that is an example of the recording material bundle. Additionally, second binding teeth 72 are provided above the first binding teeth 71.

Each of the first binding teeth 71 as an example of first teeth and the second binding teeth 72 as an example of second teeth is provided with an uneven portion.

More specifically, the surface of the first binding teeth 71 located on the side of the second binding teeth 72 and the surface of the second binding teeth 72 located on the side of the first binding teeth 71 are provided with an uneven portion in which a convex portion and a concave portion are alternately arranged in the direction indicated by arrow 4X in the drawing (a longitudinal direction of the first binding teeth 71 and the second binding teeth 72).

In a case where the binding processing is performed by the first binding teeth 71 and the second binding teeth 72, in the exemplary embodiment, the second binding teeth 72 advance toward the first binding teeth 71.

In addition, in the exemplary embodiment, in a case where the binding processing is performed, the second binding teeth 72 moves down along a linear route indicated by arrow 4Y in the drawing (hereinafter, referred to as a "linear route 4Y"), and moves toward the first binding teeth 71.

Then, in the exemplary embodiment, the paper bundle T located between the first binding teeth 71 and the second binding teeth 72 is sandwiched and pressed by the first binding teeth 71 and the second binding teeth 72.

In this case, in the exemplary embodiment, the convex portions provided on the first binding teeth 71 and the concave portions provided on the second binding teeth 72 face each other, the concave portions provided on the first binding teeth 71 and the convex portions provided on the second binding teeth 72 face each other, and the convex portions provided on the other binding teeth enter the concave portions provided on one binding teeth.

Accordingly, sheets of the paper P constituting the paper bundle T are pressure-bonded to each other, and the binding processing of the paper P is performed. Thereafter, in the exemplary embodiment, the second binding teeth 72 move upward and retreats from the first binding teeth 71.

In addition, in the exemplary embodiment, a case where the convex portions and the concave portions are alternately lined up in the first binding teeth 71 and the second binding teeth 72, respectively, has been described as an example. However, the convex portions and the concave portions may be disposed in another arrangement.

Additionally, for example, in a case where the paper bundle T is pressed by the first binding teeth 71 and the second binding teeth 72, the binding processing may be performed by cutting a part of the paper bundle T to form a strip-shaped piece, forming a through-hole may be formed in the paper bundle T, and passing the strip-shaped piece through the through-hole.

The second binding processing device 52 is provided with a moving mechanism 500 as an example of a moving unit that moves the second binding teeth 72 toward the first binding teeth 71.

The moving mechanism 500 of the exemplary embodiment includes rod-shaped screw part 510 extending in the upward-downward direction in the drawing, and the screw part 510 is rotated in the circumferential direction so as to move the second binding teeth 72 toward the first binding teeth 71. In addition, the screw part 510 only needs to have a screw portion, and may be integrated with a member having another function.

Here, the screw part 510 is disposed along the linear route 4Y in which the second binding teeth 72 move.

In addition, although the type of the screw part 510 is not particularly limited, for example, a trapezoidal screw can be used. Additionally, multiple threads may be used.

Here, in the exemplary embodiment, an interlocking portion 600 that moves in conjunction with the second binding teeth 72 is provided, and the screw part 510 meshes with the interlocking portion 600.

More specifically, the interlocking portion 600 is provided with a female screw portion 610, and in the exemplary embodiment, a screw part 510 that is a male screw meshes with the portion of the interlocking portion 600 where the female screw portion 610 is provided.

The moving mechanism 500 of the exemplary embodiment rotates the screw part 510 meshing with the female screw portion 610 in the circumferential direction to move the second binding teeth 72 toward the first binding teeth 71.

More specifically, in the exemplary embodiment, in a case where a drive motor M to be described below is rotated forward, the screw part 510 rotates in one direction in the circumferential direction, and the interlocking portion 600 moves down.

Accordingly, the second binding teeth 72 moves down, and the second binding teeth 72 move toward the first binding teeth 71. Accordingly, the binding processing is performed.

Additionally, in the exemplary embodiment, in a case where the binding processing ends, the drive, motor M rotates reversely, the screw part 510 rotates in the reverse direction, and the interlocking portion 600 moves up. Accordingly, the second binding teeth 72 moves up, and the second binding teeth 72 retreats from the first binding teeth 71.

Here, the moving mechanism 500 is provided with the drive motor M as an example of a drive source as illustrated in FIG. 5 in addition to the screw part 510.

Additionally, in the exemplary embodiment, a pinion gear (not illustrated) connected to an output shaft of the drive motor M and disposed coaxially with the output shaft is provided below the drive motor M.

Moreover, in the exemplary embodiment, as illustrated in FIG. 4, a larger-diameter gear 520 meshing with the pinion gear and receiving a driving force from the pinion gear is provided.

The larger-diameter gear 520 is disposed coaxially with the screw part 510. Additionally, in the exemplary embodiment, a lower end of the screw part 510 is fixed to the larger-diameter gear 520.

In the exemplary embodiment, the larger-diameter gear 520 is rotated by the drive motor M, and accordingly, the screw part 510 rotates in the circumferential direction.

Then, in a case where the screw part 510 rotates, the second binding teeth 72 advance and retreat with respect to the first binding teeth 71.

Here, as a configuration for moving the second binding teeth 72, a cam mechanism or a jack mechanism may be additionally used. However, in a case where the screw part 510 is used as in the exemplary embodiment, the size of the second binding processing device 52 can be reduced.

Here, in a case where the cam mechanism or the jack mechanism is used, an aspect is conceivable in which the cam mechanism or the jack mechanism is provided, for example, at a point indicated by reference numeral 4Z in FIG. 4 (above the second binding processing device 52) and the second binding teeth 72 is moved by pressing the interlocking portion 600 from above by the cam mechanism or jack mechanism.

Meanwhile, in this case, it is difficult to increase the separation amount between the first binding teeth 71 and the second binding teeth 72 while suppressing an increase in the size of the second binding processing device 52.

In addition, in the exemplary embodiment, a space between the first binding teeth 71 and the second binding teeth 72 is a paper bundle receiving portion that receives the paper bundle T. However, in a case where the cam mechanism or the jack mechanism is used, it is difficult to enlarge the paper bundle receiving portion while suppressing an increase in the size of the second binding processing device 52.

Here, in a case where the cam mechanism or the jack mechanism is used, the amount of advance and retreat of the second binding teeth 72 increases in a case where the cam mechanism or the jack mechanism is enlarged. Therefore, the paper bundle receiving portion can be enlarged. However, in this case, the size of the second binding processing device 52 is increased.

Additionally, in a case where the paper bundle receiving portion is made smaller, the size of the second binding processing device 52 can be suppressed, but in this case, the maximum number of sheets of the paper P that can be subjected to the binding processing is reduced.

In contrast, in a case where the screw part 510 is used as in the exemplary embodiment, the size of the second binding processing device 52 is suppressed, and the paper bundle receiving portion becomes larger.

Particularly, in the exemplary embodiment, as illustrated in FIG. 5, some components of the moving mechanism 500 such as the drive motor M and the screw part 510 is provided beside the linear route 4Y in which the second binding teeth 72 move. This makes it easier to secure the size of the paper bundle receiving portion while reducing the dimension of the second binding processing device 52 in the height direction.

Additionally, in the exemplary embodiment, as illustrated in FIG. 4, the larger-diameter gear 520 is disposed so as to extend in a direction intersecting the linear route 4Y in which the second binding teeth 72 move. This also reduces the dimension of the second binding processing device 52 in the height direction.

In addition, in the exemplary embodiment, a relationship in which the direction in which the linear route 4Y extends and the radial direction of the larger-diameter gear 520 intersect (are orthogonal to) each other is established. For example, the dimension of the second binding processing device 52 in the height direction is smaller than in a case where the larger-diameter gear 520 is installed in the direction in which the linear route 4Y extends.

Additionally, in the exemplary embodiment, the second binding processing device 52 is configured to be capable of passing through the end guide 64 illustrated in FIG. 3.

More specifically, in the exemplary embodiment, the maximum separation amount between the first binding teeth 71 and the second binding teeth 72 is larger than the height dimension of the end guide 64, and the end guide 64 passes through the above-described paper bundle receiving portion. Accordingly, the second binding processing device 52 passes through the end guide 64.

Here, in the exemplary embodiment, as illustrated in FIG. 4, the interlocking portion 600 is provided with a load receiving member 620 that receives a load from the screw part 510 and an upper support member 630 that supports the load receiving member 620.

Additionally, the interlocking portion 600 is provided with two rod-shaped part 640 attached to the upper support member 630 and extending downward, and a fixing member 650 for fixing each of the rod-shaped parts 640 to the upper support member 630. In addition, the rod-shaped part 640 only needs to have a rod portion, and may be integrated with a member having another function.

The fixing member 650 is constituted by a bolt 651 and a nut 652.

The bolt 651 is fixed to an upper portion of the rod-shaped part 640 and extends upward from the rod-shaped part 640. The nut 652 is located above the rod-shaped part 640 and is fixed to the bolt 651.

Here, the female screw portion 610 is supported by the load receiving member 620. Additionally, the two rod-shaped parts 640 are disposed so as to extend along the linear route 4Y.

Additionally, in the exemplary embodiment, the second binding teeth 72 are attached to the upper support member 630. More specifically, in the exemplary embodiment, the second binding teeth 72 are attached to one end 631 of the upper support member 630 located on the near side in the drawing.

Moreover, in the exemplary embodiment, a lower support member 700 that supports the first binding teeth 71 is provided below the interlocking portion 600. In other words, the lower support member 700 that supports the first binding teeth 71 is provided below the upper support member 630.

The lower support member 700 is provided with a teeth support portion 710 extending in the width direction of the second binding processing device 52 and supporting the first binding teeth 71 from below.

Moreover, the lower support member 700 is provided with a connection portion 720 that is connected to each of the ends of the teeth support portion 710 and extends from the end to the rear side of the second binding processing device 52.

Additionally, in the exemplary embodiment, as illustrated in FIG. 5, a guide portion 90 that guides the second binding teeth 72 is provided.

The guide portion 90 is provided on the lower support member 700. Additionally, the guide portion 90 is disposed along the linear route 4Y in which the second binding teeth 72 move.

In the exemplary embodiment, as described above, the rod-shaped part 640 is provided, and the guide portion 90 guides the rod-shaped part 640 to guide the second binding teeth 72.

More specifically, in the exemplary embodiment, the lower support member 700 is provided with a hole 91 extending along the linear route 4Y.

The guide portion 90 of the exemplary embodiment is constituted by an inner peripheral surface 91A of the hole 91. In the exemplary embodiment, the rod-shaped part 690 is guided using the inner peripheral surface 91A of the hole 91.

Here, the hole 91 has a circular cross section. Additionally, in the exemplary embodiment, the rod-shaped part 640 is constituted by, for example, a columnar member having a diameter of φ10 mm or more.

In the exemplary embodiment, the columnar rod-shaped part 640 constituting a part of the interlocking portion 600 (refer to FIG. 4) enters the hole 91, and the rod-shaped part 640 is guided by the inner peripheral surface 91A of the hole 91.

Figure 6:
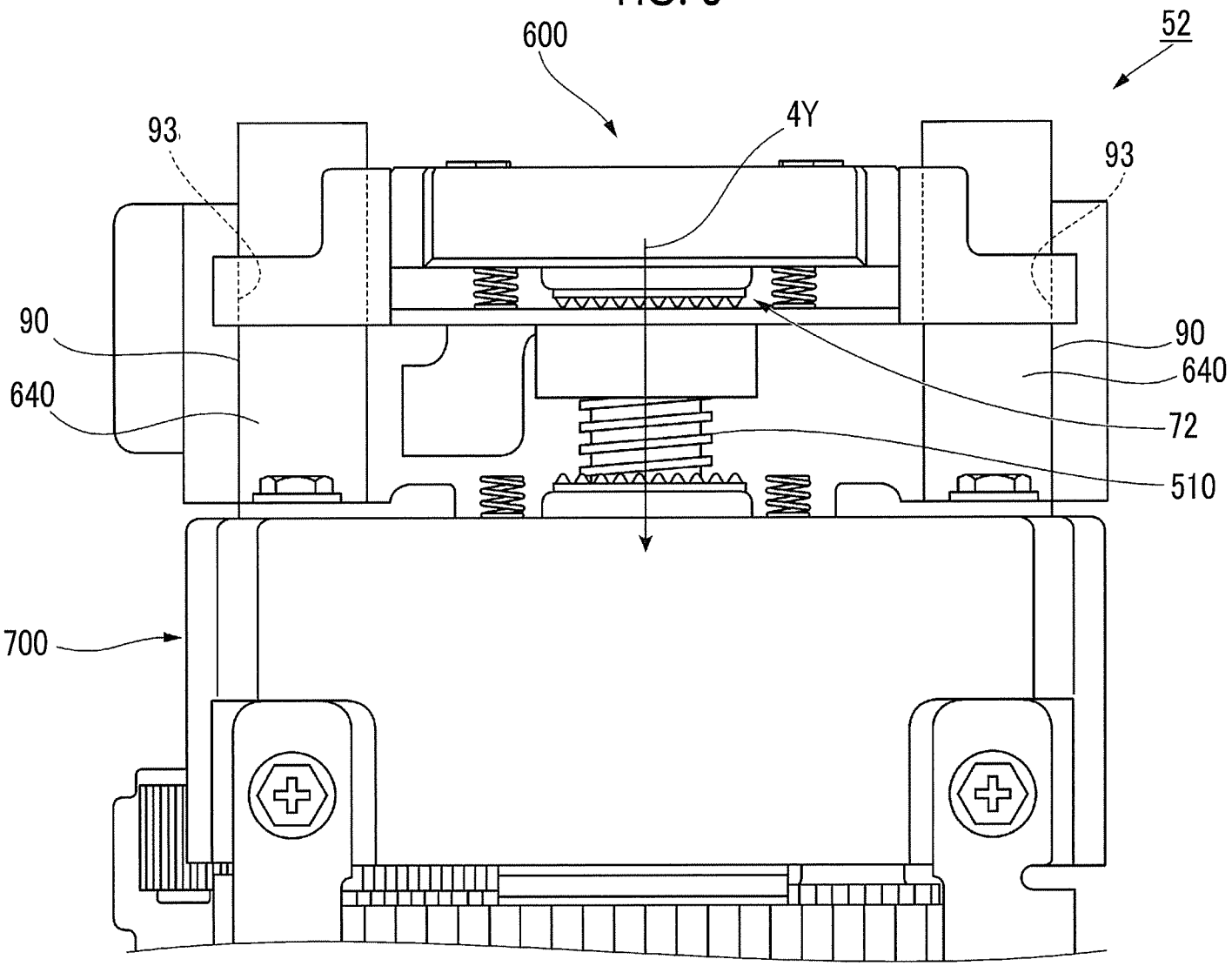
FIG. 6 is a diagram illustrating another configuration example of the second binding processing device.

In addition, as another form, for example, as illustrated in FIG. 6 (a diagram illustrating another configuration example of the second binding processing device 52), a hole 93 extending along the linear route 4Y is provided on the interlocking portion 600 side interlocking with the second binding teeth 72 may be provided, and the rod-shaped part 640 that enters the hole 93 and extends along the linear route 4Y may be provided on the lower support member 700 side.

Here, in this configuration example, the rod-shaped part 640 is fixed to the lower support member 700.

In this configuration example, an outer peripheral surface of the rod-shaped part 640 serves as the guide portion 90. In this configuration example, the outer peripheral surface is used to guide the interlocking portion 600, and the second binding teeth 72 moves up and down.

Additionally, in the exemplary embodiment (in the embodiments illustrated in FIGS. 4 and 5), the screw part 510 moves with respect to the interlocking portion 600, and the screw part 510 is movable in a direction intersecting (orthogonal to) the direction in which the screw part 510 extends.

Specifically, in the exemplary embodiment, the movement of the screw part 510 with respect to the interlocking portion 600, that is, the screw part 510 in the direction indicated by the arrow 4A in FIG. 4 is movable.

In other words, the screw part 510 is movable in the width direction of the second binding processing device 52.

Here, in the exemplary embodiment, the load receiving member 620 is movable in the direction indicated by the arrow 4A.

More specifically, in the exemplary embodiment, the load receiving member 620 is configured to be relatively movable with respect to the upper support member 630, and thereby, the load receiving member 620 in the width direction of the second binding processing device 52 is movable.

In addition, in the exemplary embodiment, the load receiving member 620 is configured to be movable with respect to the upper support member 630 and the rod-shaped part 640 that constitute a part of the interlocking portion 600.

Also, in this way, in a case where the load receiving member 620 is configured to be movable with respect to the upper support member 630 and the rod-shaped part 640, the screw part 510 is movable with respect to the upper support member 630 and the rod-shaped part 640.

More specifically, the screw part 510 is movable with respect to the upper support member 630 and the rod-shaped part 640, and the screw part 510 is movable in the direction intersecting (orthogonal to) the direction in which the screw part 510 extends. In addition, the screw part 510 is movable in the radial direction of the screw part 510.

Figure 7:
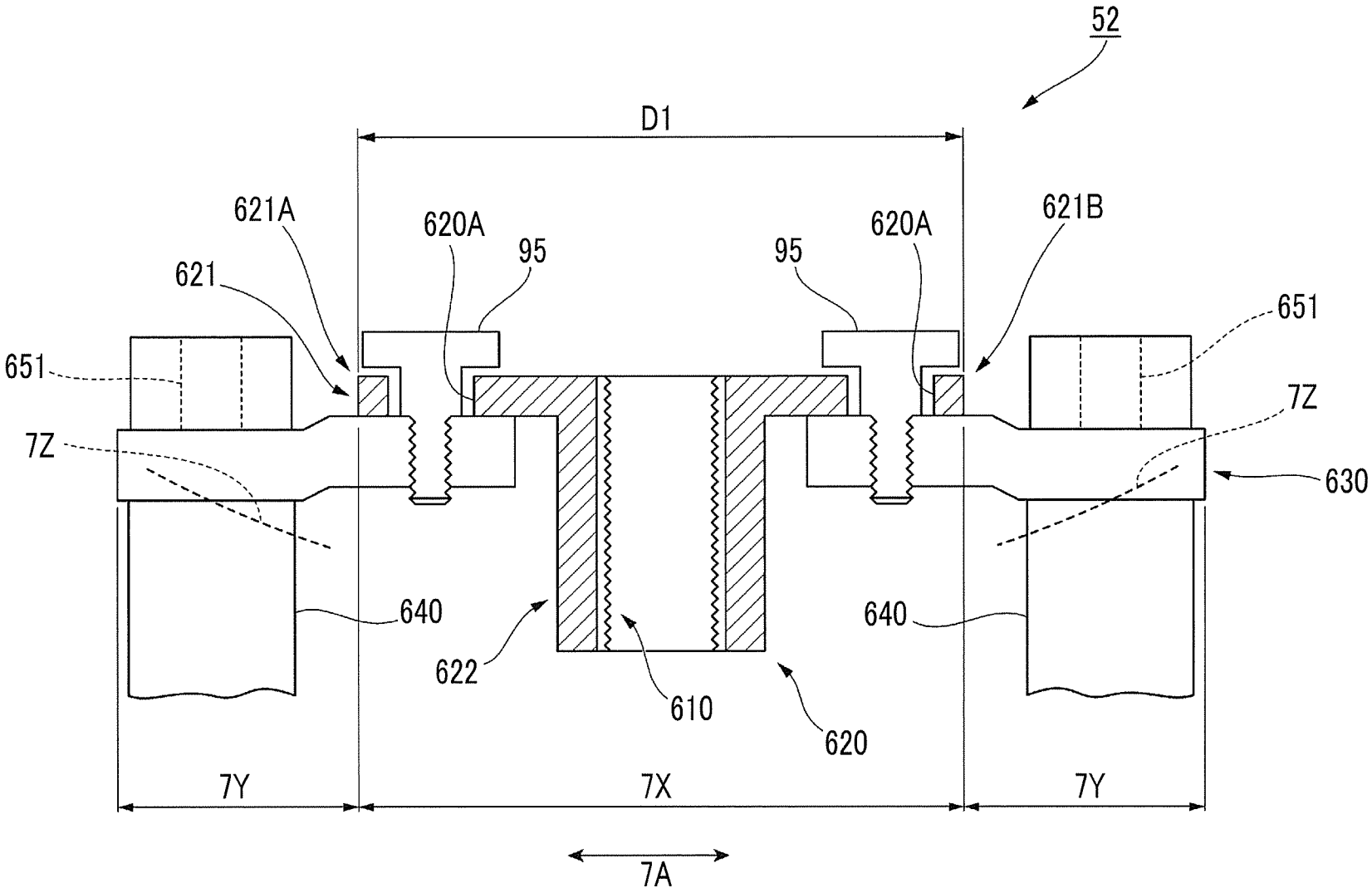
FIG. 7 is a cross-sectional view of the second binding processing device taken along line VII-VII in FIG. 4.

FIG. 7 is a cross-sectional view of the second binding processing device 52 taken along line VII-VII in FIG. 4, and is a cross-sectional view illustrating an upper portion of the second binding processing device 52.

In the exemplary embodiment, as illustrated in FIG. 7, a through-hole 620A is formed in the load receiving member 620, and a fixing screw 95 used for fixing the load receiving member 620 to the upper support member 630 is passed through the through-hole 620A.

In the exemplary embodiment, a gap is formed between an inner peripheral surface of the through-hole 620A and the fixing screw 95. Moreover, in the exemplary embodiment, no screw portion is provided on an outer peripheral surface of the portion of the fixing screw 95 located within the through-hole 620A.

Accordingly, in the exemplary embodiment, the load receiving member 620 is movable with respect to the upper support member 630, that is, the load receiving member 620 is movable in the direction indicated by arrow 7A in the drawing.

In this case, the screw part 510 is movable with respect to the upper support member 630 and the rod-shaped part 640.

In addition, in the exemplary embodiment, the screw part 510 is movable with respect to the interlocking portion 600 (refer to FIG. 4), that is, the screw part 510 is movable in the direction intersecting the direction in which the screw part 510 extends.

Here, for example, in a case where the screw part 510 is configured to be immovable with respect to the interlocking portion 600 and, for example, the screw part 510 is inclined with respect to the linear route 4Y, the second binding teeth 72 move to a position different from an original position thereof in a case where the second binding teeth 72 advance to the first binding teeth 71.

In this case, the position of the second binding teeth 72 with respect to the first binding teeth 71 deviate from an originally planned position.

In contrast, in a case where the screw part 510 is movable as in the exemplary embodiment, the inclination of the screw part 510 with respect to the linear route 4Y becomes smaller, and the deviation of the second binding teeth 72 with respect to the first binding teeth 71 becomes smaller.

Here, in the exemplary embodiment, as illustrated in FIG. 7, the load receiving member 620 has a T-shaped cross-sectional shape.

More specifically, the load receiving member 620 is constituted by a disk-shaped larger-diameter portion 621 located on an upper side in the drawing, and a smaller-diameter portion 622 located below the larger-diameter portion 621.

Here, the larger-diameter portion 621 and the smaller-diameter portion 622 are disposed coaxially with each other. Additionally, a lower end of the larger-diameter portion 621 and an upper end of the smaller-diameter portion 622 are connected to each other.

Moreover, in the exemplary embodiment, the female screw portion 610 is provided on the central axis of the load receiving member 620.

The female screw portion 610 has a tubular shape, and in the exemplary embodiment, the rod-shaped screw part 510 (refer to FIG. 4) is passed through the female screw portion 610.

Additionally, in the exemplary embodiment, a length L1 (refer to FIG. 5) of the second binding teeth 72 in the longitudinal direction is smaller than an outer diameter D1 (refer to FIG. 7) of the larger-diameter portion 621.

Additionally, in the exemplary embodiment, in a case where the position of the larger-diameter portion 621 in the radial direction is compared, the second binding teeth 72 (refer to FIG. 7) are located closer to the other end 621B than the one end 621A (refer to FIG. 4) of the larger-diameter portion 621.

Additionally, the second binding teeth 72 are located closer to the one end 621A than the other end 621B of the larger-diameter portion 621.

In addition, in the exemplary embodiment, in a case where the second binding processing device 52 is viewed from the front (in a case where the second binding processing device 52 is viewed from the side where the paper bundle receiving portion is provided), in the exemplary embodiment, the second binding teeth 72 is located between the one end 621A and the other end 621B of the larger-diameter portion 621.

Here, in the exemplary embodiment, the load receiving member 620 is pulled downward by the screw part 510, and accordingly, a portion of the upper support member 630 indicated by reference numeral 7X in FIG. 7 is uniformly pressed from above by the load receiving member 620.

In this case, the portion of the upper support member 630 that is uniformly pressed from above by the load receiving member 620 is likely to move downward while substantially maintaining a shape that extends laterally and linearly.

On the other hand, side portions (portions indicated by reference numeral 7Y in FIG. 7) of the upper support member 630 located on both sides of the pressed portion are likely to be inclined with respect to the horizontal direction as indicated by reference numeral 7Z.

In this case, for example, in a case where the dimension of the second binding teeth 72 in the longitudinal direction is large and some of the second binding teeth 72 reach the above side portions (portions indicated by reference numeral 7Y), the second binding teeth 72 are easily distorted.

In contrast, as in the exemplary embodiment, in a case where the second binding teeth 72 do not reach the side portions, and the second binding teeth 72 is fitted between the one end 621A and the other end 621B of the larger-diameter portion 621, the second binding teeth 72 are less likely to be distorted.

Additionally, in the exemplary embodiment, the second binding teeth 72 is movable with respect to the guide portion 90 (refer to FIG. 5), and the second binding teeth 72 is movable in a direction intersecting the direction in which the guide portion 90 extends.

More specifically, in the exemplary embodiment, the inner peripheral surface 91A of the hole 91 serves as the guide portion 90. In the exemplary embodiment, the second binding teeth 72 is movable in the direction intersecting the direction indicated by arrow 5X, which is the direction in which the inner peripheral surface 91A extends.

In addition, in the exemplary embodiment, the second binding teeth 72 are movable in a direction intersecting the direction in which the second binding teeth 72 advance and retreat.

Here, in the exemplary embodiment, the upper support member 630 is movable in the direction indicated by arrow 5Y.

More specifically, in the exemplary embodiment, the upper support member 630 is movable with respect to the rod-shaped part 640, and the upper support member 630 is movable in the direction indicated by the arrow 5Y.

In addition, in the exemplary embodiment, the upper support member 630 is movable with respect to the rod-shaped part 640, and the upper support member 630 is movable in the longitudinal direction of the second binding teeth 72.

Accordingly, in the exemplary embodiment, the second binding teeth 72 are moved in the longitudinal direction by moving the upper support member 630 with respect to the rod-shaped part 640.

In addition, in the exemplary embodiment, in a case where the upper support member 630 is moved with respect to the rod-shaped part 640, the second binding teeth 72 are moved in the direction intersecting the direction in which the guide portion 90 extends (the direction indicated by the arrow 5X in the drawing).

More specifically, in the exemplary embodiment, as described above and as illustrated in FIG. 5, the bolt 651 protruding upward from an upper end of the rod-shaped part 640 is provided.

Moreover, in the exemplary embodiment, a through-hole 633 through which the bolt 651 is passed is formed in the upper support member 630. The through-hole 633 is a so-called elongated hole, and is formed so as to extend in the longitudinal direction of the second binding teeth 72.

Accordingly, in the exemplary embodiment, the upper support member 630 is movable with respect to the rod-shaped part 640, and the second binding teeth 72 is movable in the direction intersecting the direction in which the rod-shaped part 640 extends.

In addition, the second binding teeth 72 are movable in the direction intersecting the direction in which the guide portion 90 extends.

More specifically, in the exemplary embodiment, after the fixing of the upper support member 630 to the rod-shaped part 640 by the bolt 651 and the nut 652 is released, the upper support member 630 is moved in the longitudinal direction of the second binding teeth 72.

Accordingly, a positional relationship between the first binding teeth 71 and the second binding teeth 72 is changed. In addition, the relative position of the second binding teeth 72 with respect to the first binding teeth 71 is adjusted.

In addition, in the exemplary embodiment, in a case where the adjustment of the position of the second binding teeth 72 ends, the nut 652 is fixed to the bolt 651, and the upper support member 630 is fixed to the rod-shaped part 640 again.

In addition, in the exemplary embodiment, the configuration in which the upper support member 630 moves in the longitudinal direction of the second binding teeth 72 has been described as an example. However, the present invention is not limited to the configuration, and a configuration may be adopted in which the upper support member 630 is moved in both of the longitudinal direction of the second binding teeth 72 and the direction orthogonal to the longitudinal direction.

In addition, in order to allow the upper support member 630 to move in both directions of the longitudinal direction and the orthogonal direction, for example, the above-described through-hole 633 formed in the upper support member 630 is formed of a round hole having a diameter larger than the outer diameter of the bolt 651.

Accordingly, the upper support member 630 moves in both directions of the longitudinal direction and the orthogonal direction.

Moreover, in the exemplary embodiment, as illustrated in FIG. 5, the drive motor M is fitted between the one end 511 and the other end 512 in the axial direction of the screw part 510. In addition, in the exemplary embodiment, the drive motor M is located beside the screw part 510.

Accordingly, in the exemplary embodiment, the size of the second binding processing device 52 in the direction in which the screw part 510 extends, in other words, in the direction in which the second binding teeth 72 advance and retreat, is reduced.

Here, in a case where the drive motor M is located, for example, at a point indicated by reference numeral 5S in FIG. 5, the second binding processing device 52 is likely to be increased in size.

In contrast, as in the exemplary embodiment, in a case where the drive motor M is located beside the screw part 510, the size of the second binding processing device 52 is suppressed from increasing.

Here, in the exemplary embodiment, the case where all or most of the drive motor M is fitted between the one end 511 and the other end 512 in the axial direction of the screw part 510 has been described.

However, the present invention is not limited to this, and as long as at least a part of the drive motor M is located closer to the other end 512 than the one end 511 in the axial direction of the screw part 510 and is located closer to the one end 511 than the other end 512, the size of the second binding processing device 52 can be reduced as compared to a configuration in which the drive motor M is not located between the one end 511 and the other end 512 at all.

Figure 8:
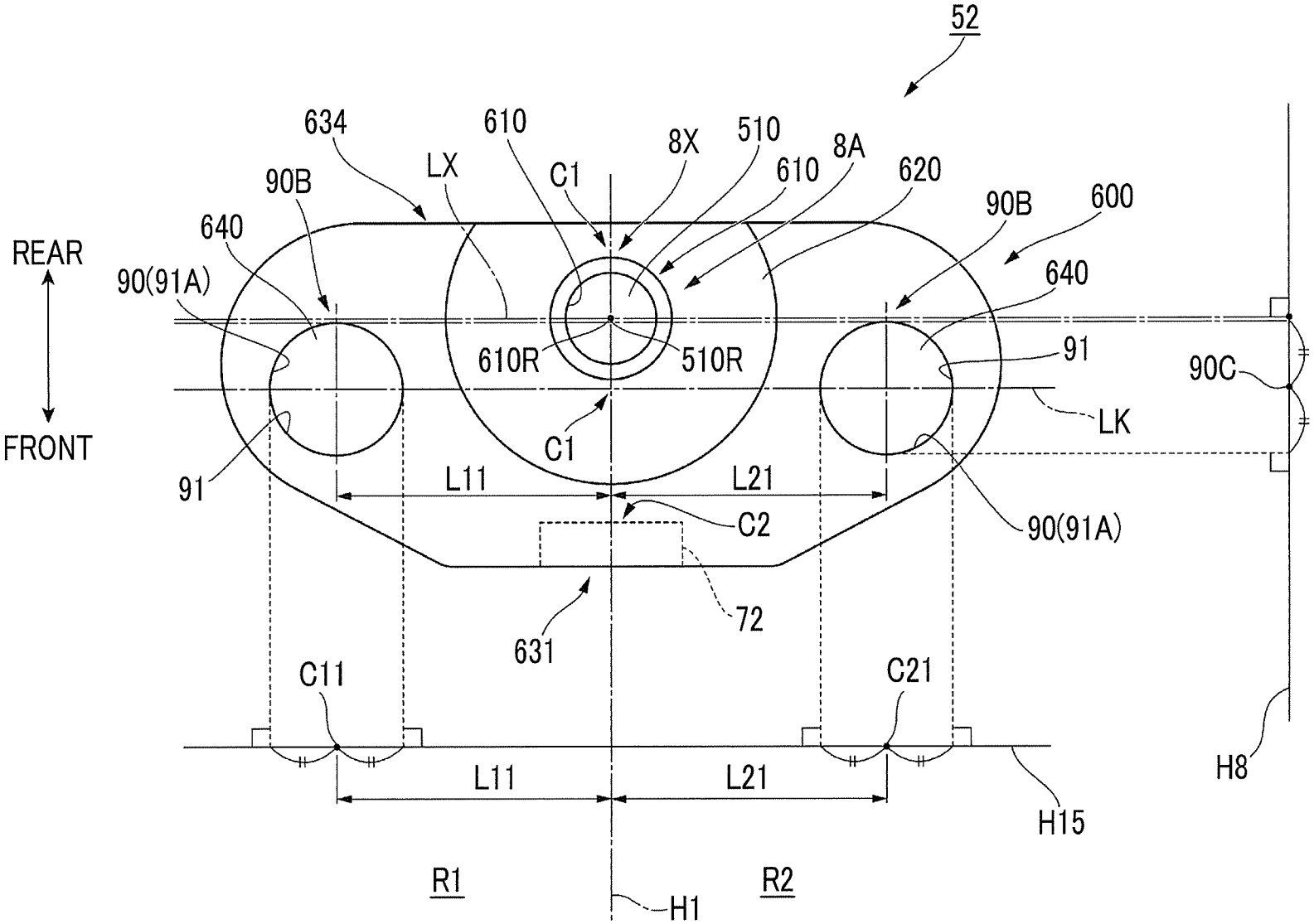
FIG. 8 is a diagram illustrating a cross section of the second binding processing device taken along line VIII-VIII in FIG. 5.

FIG. 8 is a diagram illustrating a cross section of the second binding processing device 52 taken along line VIII-VIII in FIG. 5.

The moving mechanism 500 (refer to FIG. 4) of the exemplary embodiment applies a load to a specific point of the interlocking portion 600 to move the second binding teeth 72 toward the first binding teeth 71.

More specifically, the moving mechanism 500 applies a load to a specific point (hereinafter, referred to as "load application point 8A") in the exemplary embodiment, which is indicated by reference numeral 8A (refer to FIG. 8), in the interlocking portion 600 to move the second binding teeth 72 toward the first binding teeth 71.

More specifically, in the exemplary embodiment, the load application point 8A is a point where the female screw portion 610 is provided, and in the exemplary embodiment, the interlocking portion 600 is moved to move the second binding teeth 72 toward the first binding teeth 71 by applying a load to the point where the female screw portion 610 is provided.

In the exemplary embodiment, the guide portion 90 (the inner peripheral surface 91A of the hole 91) is located closer to the second binding teeth 72 than the load application point 8A.

Here, being located closer does not mean that all portions of the guide portion 90 are located closer to the second binding teeth 72 than the load application point 8A.

In the exemplary embodiment, a rear portion 90B of the guide portion 90 located closest to the rear side is located closer to the second binding teeth 72 than a rear portion 8X of the load application point 8A located closest to the rear side.

In this way, in a case where portions located closest to the rear side are compared with each other and in a case where the rear portion 90B of the guide portion 90 is located closer to the second binding teeth 72 than the rear portion 8X of the load application point 8A, in the exemplary embodiment, it can be the that the guide portion 90 is located closer to the second binding teeth 72 than the load application point 8A.

In the exemplary embodiment, the guide portion 90 guides a portion of the interlocking portion 600 interlocking with the second binding teeth 72, which is located closer to the second binding teeth 72 than the load application point 8A, to guide the second binding teeth 72.

More specifically, the guide portion 90 guides the rod-shaped part 640 located closer to the second binding teeth 72 than the load application point 8A to guide the second binding teeth 72.

Additionally, in the exemplary embodiment, assuming a virtual plane H1 passing through the load application point 8A and the second binding teeth 72 and extending along the linear route 4Y (refer to FIG. 5), the guide portion 90 is provided in each of two regions R1 and R2 facing each other with the plane H1 interposed therebetween.

More specifically, in the exemplary embodiment, assuming the virtual plane H1 passing through a center portion C1 (a center portion of the second binding teeth 72 in the longitudinal direction) of the load application point 8A and a central portion C2 of the second binding teeth 72 in the longitudinal direction and extending along the linear route 4Y, the guide portion 90 is provided in each of two regions R1 and R2 facing each other with the plane H1 interposed therebetween.

In addition, in the exemplary embodiment, assuming the virtual plane H1 passing through an axis center 510R of the screw part 510 and the central portion C2 in the longitudinal direction of the second binding teeth 72 and along the linear route 4Y, the guide portion 90 is provided in each of two regions R1 and R2 facing each other with the plane H1 interposed therebetween.

Moreover, in the exemplary embodiment, each guide portion 90 provided in each of the two regions R1 and R2 is disposed closer to the second binding teeth 72 than the load application point 8A.

In the exemplary embodiment, in a case where the second binding teeth 72 are pushed against the paper bundle T, the second binding teeth 72 are pressed upward by a reaction, and the one end 631 side of the upper support member 630 moves upward.

In contrast, in the exemplary embodiment, as described above, each of the guide portions 90 is located closer to the second binding teeth 72 than the load application point 8A.

In this case, the upward movement of the one end 631 of the upper support member 630 is less likely to occur compared to a case where the position of the guide portion 90 (the position of the second binding processing device 52 in the depth direction) and the position of the load application point 8A (similarly, the position thereof n the depth direction) are aligned with each other.

More specifically, in the exemplary embodiment, assuming a virtual line LX passing through an axis center 610R of the female screw portion 610 and extending in the longitudinal direction of the second binding teeth 72, the guide portion 90 is located at a point deviating from the virtual line LX.

More specifically, the guide portion 90 is located closer to the second binding teeth 72 than the virtual line LX.

In addition, FIG. 8 illustrates a cross-sectional view in a case where the second binding processing device 52 is viewed from above. However, in a state where the second binding processing device 52 is viewed from above, the guide portion 90 is located closer to the second binding teeth 72 than the virtual line LX.

Here, the guide portion 90 being located closer to the second binding teeth 72 than the virtual line LX refers to a state where a central portion 90C of the guide portion 90 (a central portion in a direction in which the plane H8 extends) is located closer to the second binding teeth 72 than the virtual line LX in a case where the guide portion 90 and the virtual line LX are projected on a plane H8 having a relationship orthogonal to the longitudinal direction of the second binding teeth 72 (projected in a direction orthogonal to the plane H8).

In addition, the expression "the guide portion 90 is located closer to the second binding teeth 72 than the virtual line LX" is not limited to a state where all portions of the guide portion 90 are located closer to the second binding teeth 72 than the virtual line LX.

As described above, in a case where the central portion 90C of the guide portion 90 is located closer to the second binding teeth 72 than the virtual line LX, it can be said that the guide portion 90 is located closer to the second binding teeth 72 than the virtual line LX.

In this case, compared to a case where the guide portion 90 is located on the virtual line LX (compared to a case where the position of the virtual line LX and the position of the central portion 90C of the guide portion 90 are aligned with each other), the 631 is less likely to move upward one end of the upper support member 630.

In this case, in a case where the binding processing is performed, the second binding teeth 72 do not easily escape upward, and a larger load is exerted on the paper bundle T.

Moreover, in the exemplary embodiment, the guide portion 90 provided in each of the two regions R1 and R2 is disposed on a common straight line LK extending in the longitudinal direction of the second binding teeth 72.

In addition, the guide portion 90 provided in each of the two regions R1 and R2 is disposed on the straight line LK line extending in the longitudinal direction of the second binding teeth 72 and passing through a point other than the axis center 610R of the female screw portion 610.

Here, the guide portion 90 being disposed on the straight line LK refers to that the position of the central portion 90C (the central portion in the direction in which the plane H8 extends) of the guide portion 90 and the position of the straight line LK coincide with each other in a case where the guide portion 90 and the straight line LK are projected onto the plane H8 (projected in a direction orthogonal to the plane H8).

Moreover, in the exemplary embodiment, a distance L11 between the guide portion 90 provided in one region R1 of the two regions R1 and R2 and the plane H1 and a distance L21 between the guide portion 90 provided in the other region R2 and the plane H1 are equal to each other.

In addition, in the exemplary embodiment, the distance L11 between one guide portion 90 of the two guide portions 90 disposed on the common straight line LK and the plane H1, and the distance L21 between the other guide portion 90 and the plane H1 are equal to each other.

More specifically, in the exemplary embodiment, in a case where the plane H1, the one guide portion 90, and the other guide portion 90 are projected onto a plane H15 extending in the longitudinal direction of the second binding teeth 72 (projected in a direction orthogonal to the plane H15), in the exemplary embodiment, the distance L11 between the central portion C11 of the one guide portion 90 (the central portion in the direction in which the plane H15 extends) and the plane H1, and the distance L21 between the central portion C21 (the central portion in the direction in which the plane H15 extends) of the other guide portion 90 and the plane H1 are equal to each other.

Figure 9:
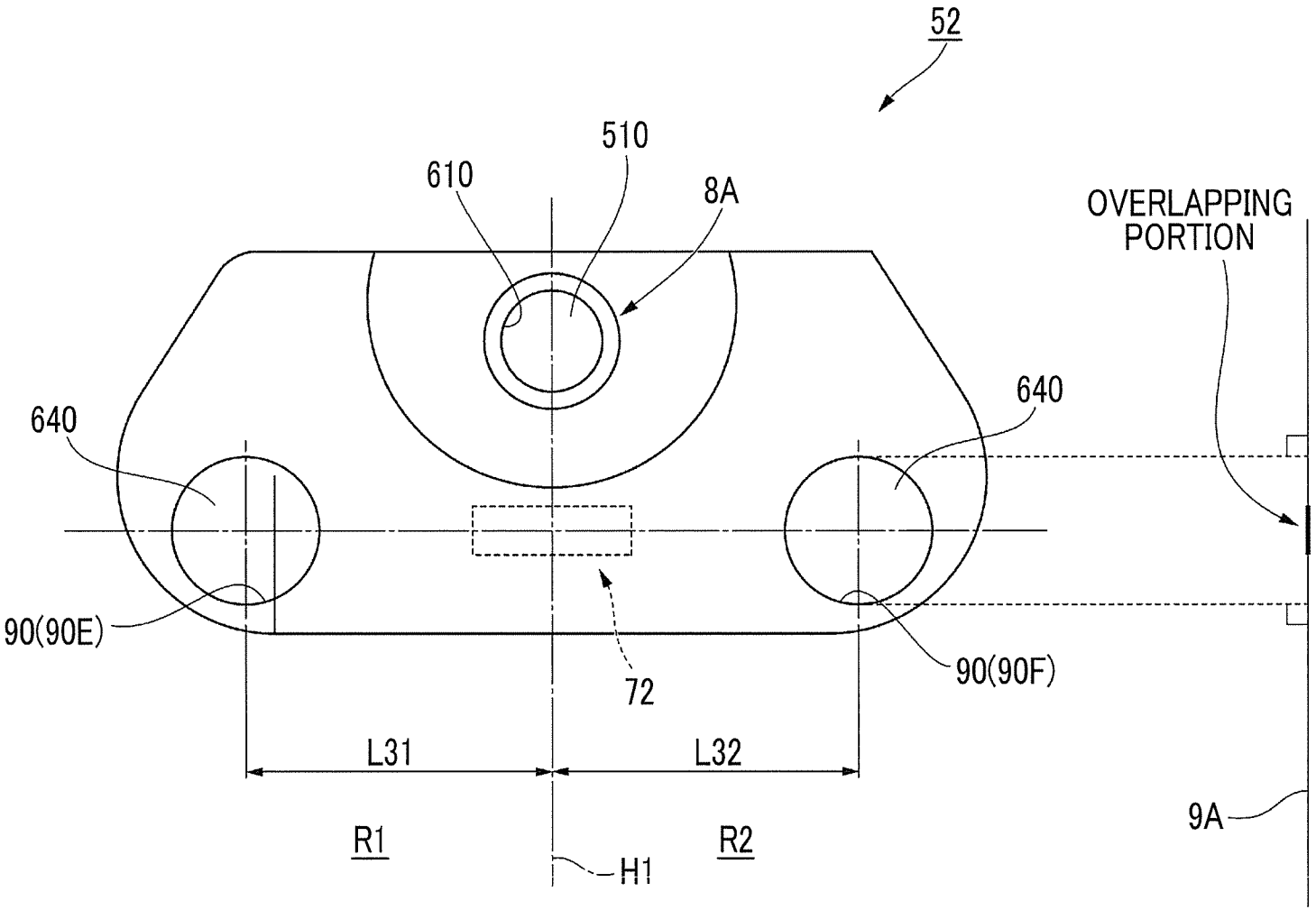
FIG. 9 is a diagram illustrating another configuration example of the second binding processing device.

FIG. 9 is a diagram illustrating another configuration example of the second binding processing device 52.

In this configuration example, similarly to the above, the plurality of guide portions 90 are provided.

Moreover, this configuration example is a configuration in which the second binding teeth 72 are located between the one guide portion 90 (hereinafter, referred to as "a guide portion 90E") included in the plurality of guide portions 90 and another guide portion 90 (hereinafter, referred to as "a guide portion 90F").

In addition, FIG. 9 illustrates a state in a case where the plurality of guide portions 90 and the second binding teeth 72 are viewed from the upstream side or the downstream side in the movement direction of the second binding teeth 72. In FIG. 9, the second binding teeth 72 are configured to be located between the one guide portion 90E and the other guide portion 90F included in the plurality of guide portions 90.

Here, the "located between" refers to a state where a portion where three including one guide portions 90E, the other guide portion 90F, and the second binding teeth 72 overlap each other is present in a case where the one guide portion 90E, the other guide portion 90F, and the second binding teeth 72 are projected on the plane 9A having a relationship orthogonal to the longitudinal direction of the second binding teeth 72 (projected in the direction orthogonal to the plane 9A).

Additionally, in the configuration example illustrated in FIG. 9, similarly to the above, assuming the virtual plane H1 passing through the load application point 8A and the second binding teeth 72 and extending along the linear route 4Y, the guide portion 90 is provided in each of the two regions R1 and R2 facing each other with the plane H1 interposed therebetween.

Moreover, in this configuration example, a distance L31 between the one guide portion 90E provided in the one region R1 and the plane H1 and a distance L32 between the other guide portion 90F provided in the other region R2 and the plane H1 are equal to each other.

Moreover, in this configuration example, as described above, the second binding teeth 72 are located between the one guide portion 90E and the other guide portion 90F.

As in this configuration example, in the configuration in which the second binding teeth 72 are located between the one guide portion 90E and the other guide portion 90F, as compared to a case where the second binding teeth 72 are located at the point separated from between the one guide portion 90E and the other guide portion 90F, the second binding teeth 72 are less likely to escape upward, and a larger load is exerted on the paper bundle T.

Here, in a case where the binding processing is performed at the binding positions illustrated in FIGS. 3A and 3B, in order to avoid interference between the rod-shaped part 640 and the paper bundle T, as in the configuration example illustrated in FIG. 8, for example, a configuration is adopted in which the rod-shaped part 640 and the guide portion 90 are not provided on both sides of the second binding teeth 72.

In contrast, for example, in the second binding processing device 52 that performs binding only at the corners of the paper bundle T, as illustrated in FIG. 9, the paper bundle T can be bound even in a configuration in which the second binding teeth 72 are located between the one guide portion 90E and the other guide portion 90F.

In addition, alternatively, the guide portion 90 may be provided on the side opposite to the side where the second binding teeth 72 are located, with the load application point 8A interposed therebetween.

In the exemplary embodiment, as described above, the second binding teeth 72 receive a reaction from the paper bundle T, and the one end 631 of the upper support member 630 moves upward. In this case, the other end 634 (refer to FIG. 8) of the upper support member 630 moves downward.

In a case where the guide portion 90 is provided on the side opposite to the side where the second binding teeth 72 are located with the load application point 8A interposed therebetween, the downward movement of the other end 634 of the upper support member 630 is restricted. Accordingly, also in this case, the upward movement of the one end 631 of the upper support member 630 is restricted.

Also in this case, the second binding teeth 72 are unlikely to escape upward, and a larger load is exerted on the paper bundle T.

Figure 10:
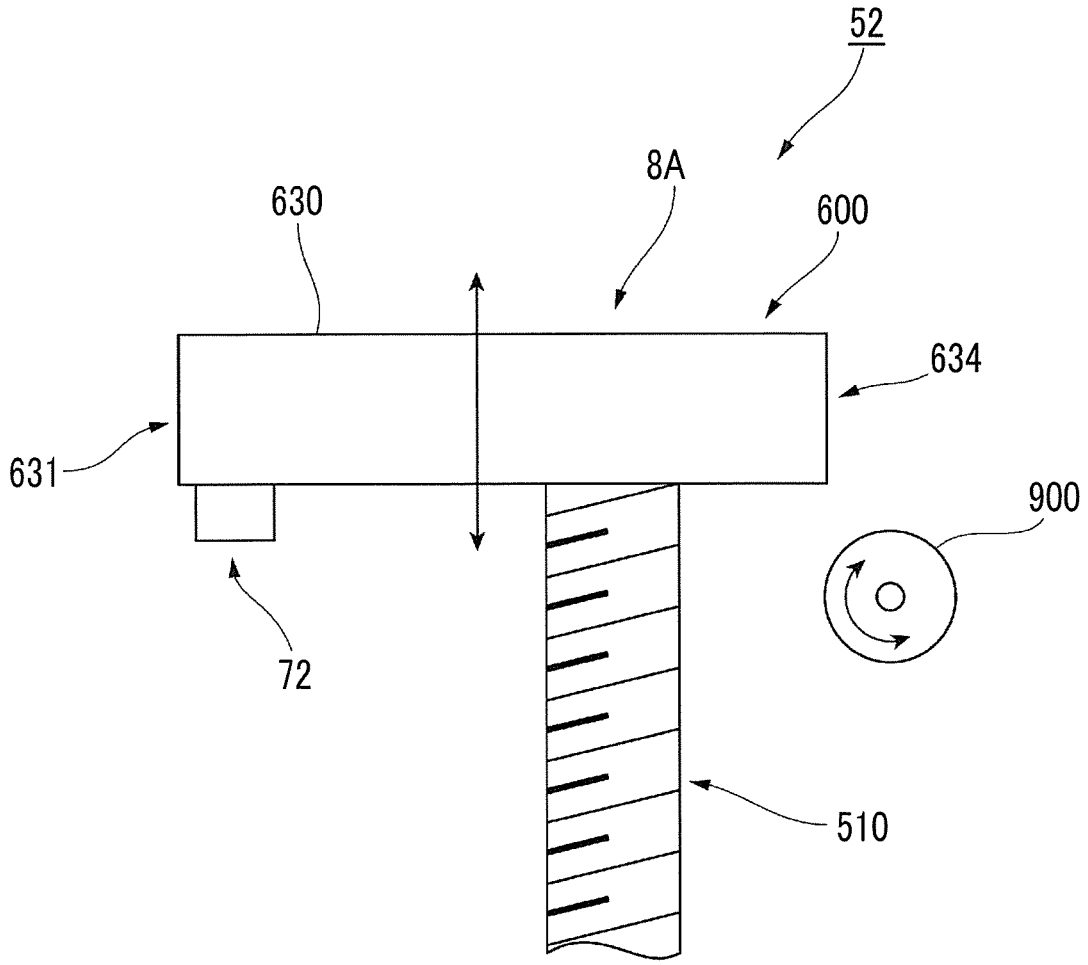
FIG. 10 is a diagram illustrating another configuration example of the second binding processing device in a case where an interlocking portion and the like are viewed from a direction indicated by arrow X in FIG. 5.

FIG. 10 is a diagram illustrating another configuration example of the second binding processing device 52 in a case where the interlocking portion 600 and the like are viewed from the direction indicated by the arrow X in FIG. 5. Here, in FIG. 10, the interlocking portion 600, the screw part 510, and the like are illustrated, and the illustration of other members is omitted.

In the configuration example illustrated in FIG. 10, a restricting portion 900 that restricts the movement of the interlocking portion 600 is provided. More specifically, in this configuration example, the restricting portion 900 is provided that restricts the movement of a portion of the interlocking portion 600 located on the side opposite to the side where the second binding teeth 72 are located with the load application point 8A interposed therebetween.

More specifically, in this configuration example, the restricting portion 900 comes into contact with the other end 634 located on the side opposite to the one end 631 that is an end of the upper support member 630 on the side where the second binding teeth 72 are provided, and restricts the downward movement of the other end 634.

Here, in the exemplary embodiment, as described above, the second binding teeth 72 receive a reaction from the paper bundle T, and accordingly, the other end 634 of the upper support member 630 moves downward. The restricting portion 900 restricts the downward movement of the other end 634.

Accordingly, also in this case, the second binding teeth 72 is less likely to escape upward, and a larger load is exerted on the paper bundle T.

Here, the restricting portion 900 of the exemplary embodiment is configured by a rotating body, and restricts the downward movement of the other end 634 while allowing the downward movement of the other end 634.

In addition, the restricting portion 900 is not limited to this, and for example, an inclined surface formed so as to extend in the upward-downward direction and approaching the other end 634 side as the lower side may be provided, and the movement of the other end 634 may be restricted by the inclined surface.

Figure 11:
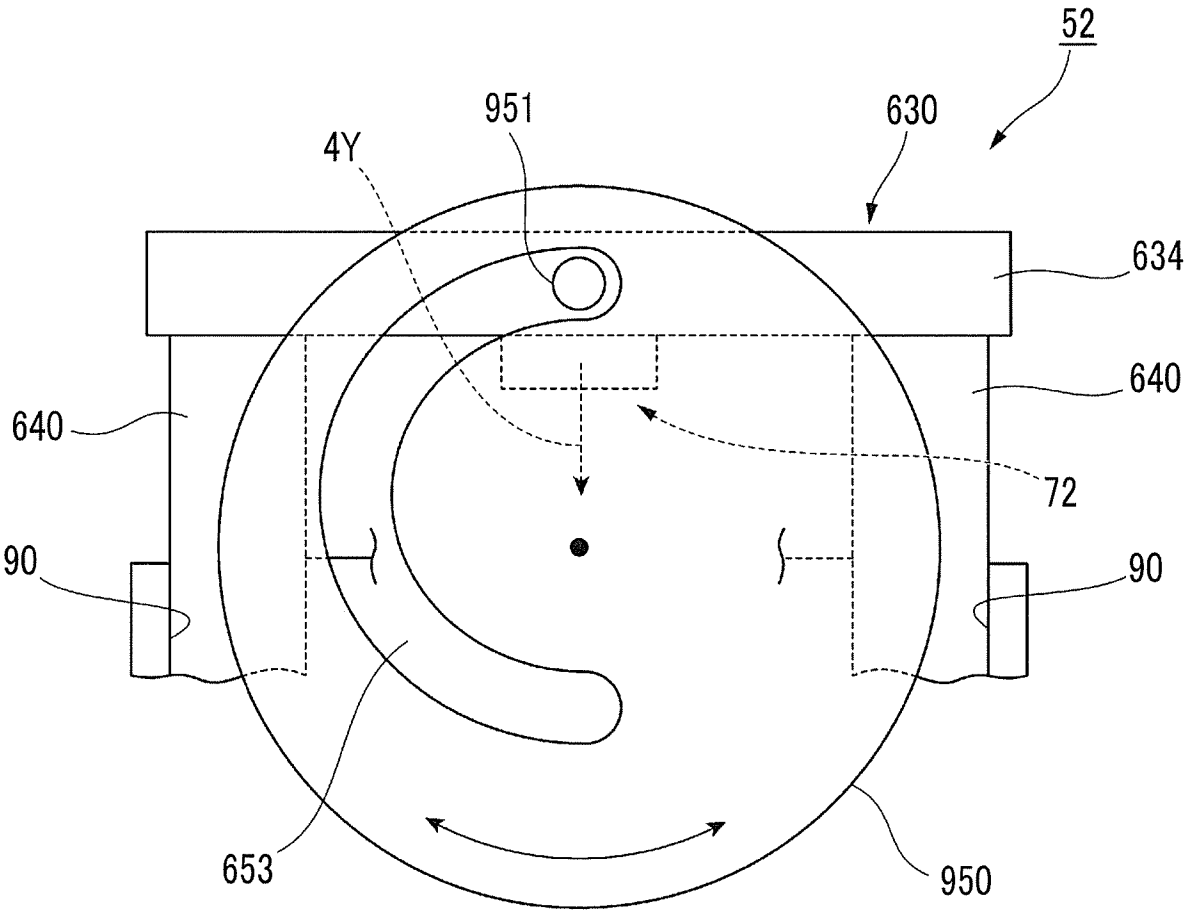
FIG. 11 is a diagram illustrating another configuration example of the second binding processing device.

FIG. 11 is a diagram illustrating another configuration example of the second binding processing device 52.

Here, FIG. 11 illustrates a part of the second binding processing device 52 in a case where the second binding processing device 52 is viewed from the direction of arrow XI in FIG. 4. In addition, FIG. 11 illustrates a state in a case where a part of the second binding processing device 52 is viewed from the rear side of the second binding processing device 52.

In the configuration example illustrated in FIG. 11, a rotating member 950 that is rotated by a drive source such as a motor is provided behind the second binding processing device 52.

Moreover, in this configuration example, a projection 951 protruding toward the rotating member 950 is provided on the other end 634 of the upper support member 630.

A groove 653 that houses the projection 951 provided on the upper support member 630 and guides the projection 951 is formed in the rotating member 950. In the configuration example, as the projection 951 is guided by an inner surface of the groove 653, the upper support member 630 moves up and down, and accordingly, the second binding teeth 72 move up and down.

In addition, in the configuration example, similarly to the above, the rod-shaped part 640 is provided, and the guide portion 90 for guiding the rod-shaped part 640 is provided, and the second binding teeth 72 move up and down along the linear route 4Y.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material processing apparatus comprising:
first teeth that are used for binding processing of a recording material bundle;
second teeth that move along a linear route toward the first teeth and presses the recording material bundle located between the first teeth and the second teeth;
a guide portion that is disposed along the linear route and guides the second teeth moving toward the first teeth; and
a moving unit that moves the second teeth toward the first teeth,
wherein the moving unit rotates a screw part that meshes with an interlocking portion interlocking with the second teeth in a circumferential direction to move the second teeth toward the first teeth.

2. The recording material processing apparatus according to claim 1,
wherein the screw part is disposed along the linear route.

3. The recording material processing apparatus according to claim 1,
wherein the screw part is movable with respect to the interlocking portion in a direction intersecting a direction in which the screw part extends.

4. The recording material processing apparatus according to claim 1, further comprising:
a drive source that rotates the screw part,
wherein at least a part of the drive source is located closer to one end than the other end of the screw part in an axial direction or closer to the other end than the one end.

5. The recording material processing apparatus according to claim 1,
wherein the guide portion guides a rod-shaped part interlocking with the second teeth and extending along the linear route to guide the second teeth.

6. The recording material processing apparatus according to claim 5,
wherein the rod-shaped part includes a columnar member,
wherein a hole into which the columnar member enters, of which a cross section is formed in a circular shape, and which extends along the linear route is further provided, and
wherein the guide portion guides the columnar member using an inner peripheral surface of the hole to guide the second teeth.

7. The recording material processing apparatus according to claim 1,
wherein a rod-shaped part that enters a hole provided in an interlocking portion interlocking with the second teeth and extends along the linear route is further provided, and
wherein the guide portion guides the interlocking portion using the rod-shaped part to guide the second teeth.

8. The recording material processing apparatus according to claim 1, further comprising:
the moving unit that applies a load to a specific point of the interlocking portion interlocking with the second teeth to move the second teeth toward the first teeth,
wherein the guide portion guides a portion of the interlocking portion interlocking with the second teeth, which is located closer to the second teeth than the specific point, to guide the second teeth.

9. The recording material processing apparatus according to claim 1,
wherein a plurality of the guide portions are provided, and
wherein in a case where the plurality of guide portions and the second teeth are viewed from an upstream side or a downstream side in a movement direction of the second teeth, the second teeth are located between one guide portion and another guide portion included in the plurality of guide portions.

10. An image forming system comprising:
an image forming apparatus that forms an image on a recording material; and
a recording material processing apparatus that performs binding processing on a recording material bundle including a plurality of sheets of recording materials on which an image is formed by the image forming apparatus,
wherein the recording material processing apparatus is constituted by the recording material processing apparatus according to claim 2.

11. A recording material processing apparatus comprising:
first teeth that are used for binding processing of a recording material bundle;

second teeth that move along a linear route toward the first teeth and presses the recording material bundle located between the first teeth and the second teeth;

a guide portion that is disposed along the linear route and guides the second teeth moving toward the first teeth; and a moving unit that applies a load to a specific point of an interlocking portion interlocking with the second teeth to move the second teeth toward the first teeth, wherein, assuming a virtual plane passing through the specific point and the second teeth and extending along the linear route, the guide portion is provided in each of two regions facing each other with the plane interposed therebetween, wherein each of the guide portions provided in each of the two regions is disposed closer to the second teeth than the specific point.

12. The recording material processing apparatus according to claim 11, wherein each of the guide portions provided in each of the two regions is disposed on a common straight line extending along a longitudinal direction of the second teeth.

13. The recording material pressing apparatus according to claim 12, wherein a distance between the guide portion provided in one of the two regions and the plane is equal to a distance between the guide portion provided in the other region and the plane.

14. A recording material processing apparatus comprising:

first teeth that are used for binding processing of a recording material bundle;

second teeth that move along a linear route toward the first teeth and presses the recording material bundle located between the first teeth and the second teeth; and a guide portion that is disposed along the linear route and guides the second teeth moving toward the first teeth, wherein the second teeth is movable with respect to the guide portion, and the second teeth is movable in a direction intersecting a direction in which the guide portion extends.

15. The recording material processing apparatus according to claim 14, further comprising:

a moving unit that applies a load to a specific point of an interlocking portion interlocking with the second teeth to move the second teeth toward the first teeth; and a restricting portion that restricts movement of a portion of the interlocking portion that is located on a side opposite to a side on which the second teeth is located with the specific point interposed therebetween.

* * * * *